United States Patent [19]

Kellis

[11] 4,027,387

[45] June 7, 1977

[54] RAZOR BLADE CONDITIONING DEVICE

[76] Inventor: Harry Garfield Kellis, Rte. 5, Box 500, Ocala, Fla. 32670

[22] Filed: Oct. 16, 1975

[21] Appl. No.: 622,869

[52] U.S. Cl. ..... 30/90; 134/30; 134/182

[51] Int. Cl.[2] ..... A45D 27/46

[58] Field of Search ..... 30/41, 90; 134/30, 117, 134/182, 183, 198, 200, 201

[56] References Cited

UNITED STATES PATENTS

| | | | |
|---|---|---|---|
| 1,189,118 | 6/1916 | Jonas | 30/90 X |
| 2,202,516 | 5/1940 | Calleo | 134/200 |
| 2,455,152 | 11/1948 | Wolpert | 30/41 |
| 2,689,576 | 9/1954 | Colstad | 134/30 X |
| 3,009,468 | 11/1961 | Eberle | 134/200 X |
| 3,421,527 | 1/1969 | Dettman | 134/182 X |
| 3,543,776 | 12/1970 | Layton | 134/182 X |

FOREIGN PATENTS OR APPLICATIONS

| | | | |
|---|---|---|---|
| 631,749 | 11/1949 | United Kingdom | 30/90 |

*Primary Examiner*—Gary L. Smith
*Attorney, Agent, or Firm*—Roger L. Martin

[57] ABSTRACT

A device for conditioning safety razor blades has on open top receptacle for receiving the head of a safety razor containing the blade to be conditioned, and a covering component which has a chamber with fluid discharge passages that communicate with the compartment formed by the receptacle in the assembled state of the device. The covering component has a resiliently deformable adapter that serves as a fluid inlet to the chamber and is used for coupling the chamber to the outlet of a conventional household water faucet.

1 Claim, 3 Drawing Figures

RAZOR BLADE CONDITIONING DEVICE

BACKGROUND OF THE INVENTION

The invention relates to a razor blade conditioning device which is designed to prolong the useful life of used safety razor blades.

Razor blades have a limited useful life before they become dull. Various devices have been proposed and used for resharpening such blades, but the devices are usually complicated and expensive to manufacture and of course required removal of the blade from the safety razor in order for it to be resharpened through use of the device.

SUMMARY OF THE INVENTION

The inventor has found that the useful life of a safety razor blade can be prolonged and extended if the blade is subjected after each use to a forceful water flushing action while it still remains in the razor head. It is believed that the debris and residual soaps and lubricants which cling to the blade and metal parts of the razor after a shave continue to build up on the blade and razor with each subsequent use and provide a false dullness well in advance of the actual useful life of the blade. The inventor overcomes this problem by providing a device for conditioning the blade with a forceful water flushing action while it remains in the razor head. The device has a container or receptacle in which the razor head is received and in which the blade is subjected to the flushing action. The device has a covering component for the receptacle and this component has a plenum chamber from which the water is forcefully directed over the razor head and blade. The cover component is equipped with a water inlet and provisions are made for coupling the chamber to the outlet of a conventional water faucet, as will be subsequently seen.

A general object of the invention is to provide a device that may be used to prolong the useful life of razor blades. Another object is to provide a device of the kind contemplated and which is relatively inexpensive to manufacture and convenient to use. Still another object is to provide a device which maybe used to cleanse a safety razor blade without removing the blade from the razor head and which through use of the device provides an extended useful life for the blade. Another object is to provide a process for conditioning used razor blades for further use in shaving beards.

BRIEF DESCRIPTION OF THE DRAWINGS

The novel features which are believed to be characteristic of the invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
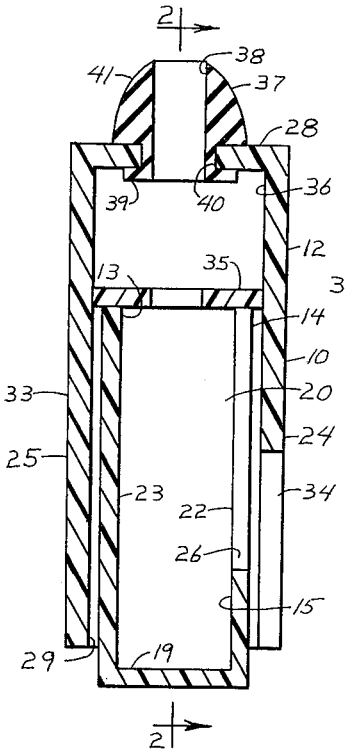
FIG. 1 shows a conditioning device embodying the principles of the invention, the device being shown on a enlarged scale and as seen in vertical transverse section taken generally along the lines 1—1 of FIG. 2.
Figure 2:
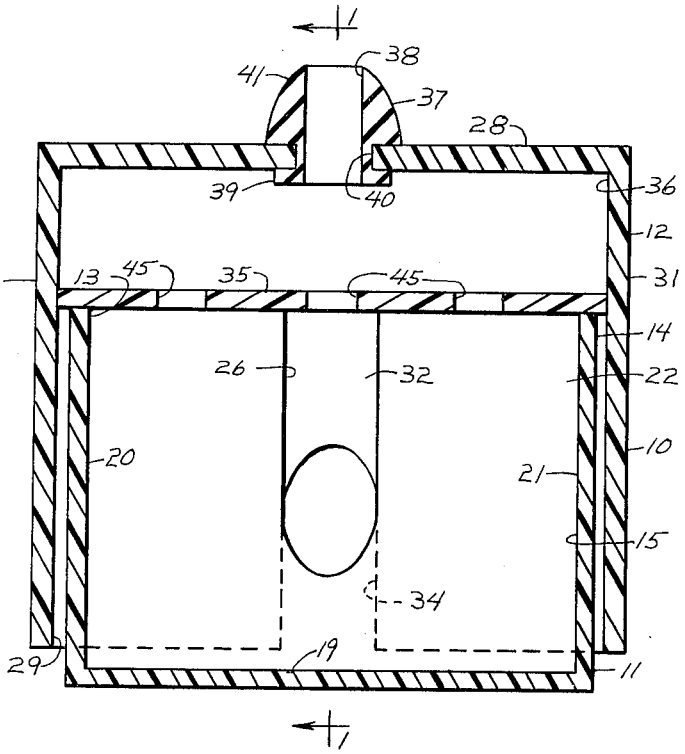
FIG. 2 shows the device in vertical section taken generally along the lines 2—2 of FIG. 1.

Reference is now made to the drawings and more particularly to FIGS. 1 and 2 and wherein the blade conditioning device is designated at 10.

Device 10 includes a generally rectangular, box-like receptacle 11 and a generally rectangular, box-like covering component 12 which is adapted to telescope onto the receptacle 11 and cover the upper opening 13 in the top portion 14 of the receptacle.

Figure 3:
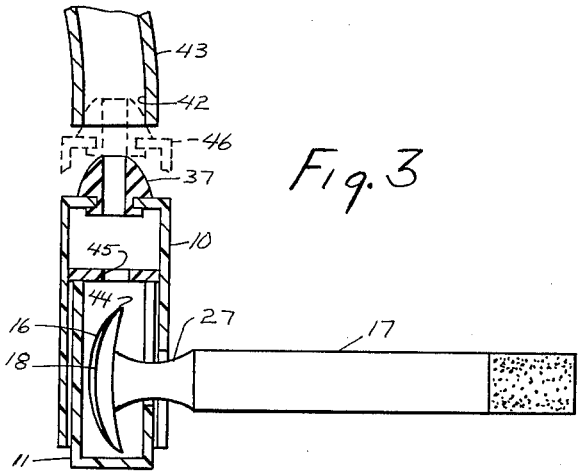
FIG. 3 shows the device seen in FIG. 1 on a scale which is reduced in comparison to that seen in FIG. 1 and 2 and where the head of a razor containing the blades is seen in a position to be conditioned through use of the device, the drawing also illustrating the means by which the device is coupled to the outlet of a conventional household water faucet.

The receptacle 11 provides a compartment 15 in the assembled device 10 for housing the blade containing head 16 of the safety razor 17 shown in FIG. 3. The receptacle 11 includes a bottom wall 19 and four side walls that include opposite end walls 20 and 21 and opposite walls 22 and 23 which are respectively located at the front 24 and back 25 of the device structure. These walls, 20 through 23, are spaced apart to accommodate reception when the device is disassembled of the razor head 16 through the upper opening 13. The front wall 22 has an upwardly opening slot 26 that accommodates the neck 27 of the razor as it is received in the receptacle and as it assumes the position shown in FIG. 3. The covering component 12 has a top wall 28 and four depending side walls that are arranged to provide an opening 29 at the bottom of the covering component. The side walls include opposite end walls, 30 and 31, and opposing front and back walls, 32 and 33. The front wall 32 has a downwardly opening slot 34 which is aligned with the slot 26 in wall 22 so as to facilitate the location of the razor neck 27 when the covering component is telescoped down and onto the receptacle 11.

The covering component 12 has a rectangular plate 35 which is off-set from the top wall 28 and fixed along its perimeter to the four surrounding walls, 30 through 33. This arrangement provides a chamber 36 in the upper portion of component 12 for receiving a pressurized fluid that is thereafter dispensed to the compartment 15 when the device 10 is assembled.

The top wall 28 has a circular opening 40 which is located generally intermediate the opposite end walls 30 and 31. Here the covering component 12 is equipped with a grommet 37 that has a center opening 38 which provides a fluid inlet to chamber 36. The grommet 37, is seen in the drawings, has a circular radially extending lower flange portion 39 which laps the underside of the top wall 28 about the opening 40. The flange 39 serves to secure the grommet to the top wall structure of the covering component. The upper portion 41 of grommet 37 is in the form of a truncated ellipse so that it converges upwardly. This arrangement enables the upper end of the grommet to be received in the outlet 42 of a conventional household water faucet 43 and facilitates a coupling of the outlet 42 to chamber 36 for the passage of water from the faucet to the chamber 36 of device 10 during use of the device.

The receptacle 11 is arranged so that as the head 16 of the razor 17 is received in the compartment 15, the head assumes a position in the compartment such that the cutting edge 44 of the blade 18 faces the internal distributer plate 35 of the covering component 12. This plate 35 has a plurality of holes that form outlet passages 45 for chamber 36 and through which the water admitted to chamber 36 during use of device is discharged into compartment 15. This arrangement provides a forceful flow of water onto the cutting edge of the blade 18 in the razor head 16 and provides the desired forceful water flushing action. Other passage arrangements may be used, such as slots, the principal desire being to provide a forceful discharge of the water from the chamber and in a direction which is generally parallel with and in the general plane of the blade 18 in the razor head 16.

It is recommended that the blade in the razor be conditioned after each shave through the use of device 10. Normally this conditioning is done by first removing the covering component 12 from receptacle 11. Thereupon, the razor head 16 is inserted in compartment 15, as illustrated in FIG. 3, so that the neck 27 extends through the slot 26 in receptacle 11 and with the handle extending laterally of the front wall 22. The covering component 12 is then placed upon the receptacle 11 and telescoped downwardly until the internal distributer plate 35 covers the receptacle opening 13 and rest upon or seats against the upper extremities of the receptacle walls, 20 through 23. Using the fingers to maintain the assembled condition, the device is then manipulated so that the upper portion 41 of grommet 37 enters the outlet 42 of the water faucet 43. The grommet is preferably made of rubber or other suitable resiliently deformable material that enables it to deform in the outlet and provide a seal along the edges of the faucet as generally illustrated by the broken line position 46 in FIG. 3.

In practice, experience as shown that the chamber 36 should be first connected to a pressurized hot water source that is preferably at a temperature in excess of about 110° Fahrenheit. The flushing action with the hot water in such circumstances is preferably continued for about 5 or 10 seconds and thereafter the chamber is connected to a pressurized cold water source.

When the faucet 43 is connected to a pressurized water source, the water enters chamber 36 through the opening 38 and the valve of the faucet is regulated so that the water in the chamber is maintained under a pressurized condition that causes the water to discharge through the passages 45 and into contact with the blade and razor head in receptacle 13. Experience has also shown that the conditioning action prolongs the useful life of conventional blades from 2 to 12 times that normally experienced without use of the device. It is believed that this result is secured because the debris and residual soaps and lubricants that normally remain in the blade and razor head after shaving are forcefully flushed out of the razor head during the conditioning process. During the flushing action the water admitted to compartment 15 will pass out through the slots in walls 22 and 32 and in most cases it is recommended that the valve of the water faucet be controlled to provide a pressure in compartment 15 that tends to unseat the plate 35 at the upper extremities of the receptacle 11 while nevertheless being retained together by the fingers.

The receptacle 11 and covering component may be made of any suitable material but is preferably made of a moldable plastic to facilitate a low manufacturing cost.

What is claimed as new and what it is desired to secure by Letters Patent of the United States is:

1. A device for use in conditioning a used safety razor blade for further use comprising a receptacle having side walls which are spaced apart and define a compartment with an open top portion that is arranged to accomodate reception of a blade containing head of a safety razor into the compartment, a component manipulatable to a covering position with respect to the open top portion of the receptacle and having a chamber for receiving a pressurized fluid, said component being arranged to telescopically fit onto said receptacle and having depending side walls that lap the side walls of the receptacle in said covering position, and means for coupling a household water faucet outlet to the chamber which is mounted on the component and arranged to define a fluid inlet to the chamber; said component having fluid distributor means which overlies the open top portion and separates the compartment and chamber in the covering position for the components, said distributor means having at least one passage for the discharge of fluid from the chamber into the compartment, and one of the side walls of said receptacle having an upwardly opening slot that is arranged to receive the neck of the safety razor when the head thereof is received in said compartment.

* * * * *